US011842864B2

(12) United States Patent
Pizzato

(10) Patent No.: US 11,842,864 B2
(45) Date of Patent: Dec. 12, 2023

(54) CONTROL STATION FOR ELECTRICAL INSTALLATION

(71) Applicant: PIZZATO ELETTRICA S.R.L., Marostica (IT)

(72) Inventor: Marco Pizzato, Marostica (IT)

(73) Assignee: PIZZATO ELETTRICA S.R.L., Marostica (IT)

( * ) Notice: Subject to any disclaimer, the term of this patent is extended or adjusted under 35 U.S.C. 154(b) by 209 days.

(21) Appl. No.: 16/349,668

(22) PCT Filed: Nov. 10, 2017

(86) PCT No.: PCT/IB2017/057032
§ 371 (c)(1),
(2) Date: May 14, 2019

(87) PCT Pub. No.: WO2018/092008
PCT Pub. Date: May 24, 2018

(65) Prior Publication Data

US 2019/0295787 A1 Sep. 26, 2019

(30) Foreign Application Priority Data

Nov. 15, 2016 (IT) ..... 102016000114323

(51) Int. Cl.
*H01H 3/02* (2006.01)
*H01H 9/02* (2006.01)
(Continued)

(52) U.S. Cl.
CPC ..... *H01H 3/022* (2013.01); *H01H 9/0214* (2013.01); *H01H 13/04* (2013.01);
(Continued)

(58) Field of Classification Search
CPC ..... H01H 9/0214; H01H 13/04; H01H 13/14; H01H 13/70; H01H 2205/002; H01H 3/022
(Continued)

(56) References Cited

U.S. PATENT DOCUMENTS 6,930,267 B2 * 8/2005 Chou ..... H01H 3/022 200/334
10,593,489 B2 * 3/2020 Oomori ..... H01H 13/84
2017/0029007 A1 * 2/2017 Nakagawa ..... H01H 13/14

FOREIGN PATENT DOCUMENTS

EP 1641006 A1 * 3/2006 ..... H01H 9/0214
EP 1772879 A2 * 4/2007 ..... H01H 3/0253

* cited by examiner

*Primary Examiner* — Lheiren Mae A Caroc
(74) *Attorney, Agent, or Firm* — Mark M. Friedman

(57) ABSTRACT

A control station for electrical installation comprises a protection box (2) having a side wall (3) with a front face (4) defining a development plane (π), a plurality of controls (5, 9, 20) anchored to the protection box (2), at least one of the controls being a mushroom emergency push button (9), movable electrical contacts associated with respective controls (5, 9, 20) to be connected to one or more circuits of the electrical installation for the opening/closing thereof. Each control (5, 9, 20) is associated with one or more contact units (22) having movable electrical contacts arranged in the protection box (2). The emergency push button (9) is housed in a seat (8) formed on a side face (7) of the side wall (3) perpendicular to the development plane (π) and is anchored to one or more contact units (22) removably housed in the protection box (2).

7 Claims, 5 Drawing Sheets

(51) Int. Cl.
*H01H 13/04* (2006.01)
*H01H 13/14* (2006.01)
*H01H 13/70* (2006.01)

(52) U.S. Cl.
CPC ..... *H01H 13/14* (2013.01); *H01H 13/70* (2013.01); *H01H 2205/002* (2013.01)

(58) Field of Classification Search
USPC ..... 200/238, 509, 510, 334, 293
See application file for complete search history.

CONTROL STATION FOR ELECTRICAL INSTALLATION

TECHNICAL FIELD

The present invention finds application in the field of devices for the control of electrical systems and has for object a control station for electrical plants, in particular for transport or movement systems such as elevators, hoists and similar.

STATE OF THE ART

The known control stations or pushbuttons for the control of electrical systems, such as elevators, hoists and similar handling and transport systems, generally comprise a box for housing the contact units to be connected to the various power and service circuits.

Each contact unit is associated with a respective external control, such as push-buttons, switches, selectors, mushroom-type emergency pushbuttons and the like, according to the functions provided for the control station.

Typically, the controls are housed in corresponding holes all made on the same face of the box, generally the wider front face.

An example of a similar control station is shown in EP2447972, in the name of the same Applicant.

A problem common to all these control stations is represented by the fact that they have considerable dimensions in thickness.

This condition may represent a limitation especially in cases wherein the control stations are designed to be installed inside the pit of elevators, hoists and similar transport systems, for the control of the system during inspection and maintenance.

In these cases, in fact, a too high thickness or height of the box may require a greater need for space, not always available.

This drawback is even more relevant in those cases in which the control station is provided with a mushroom-type emergency button, which is notoriously the bulkiest control.

In these cases, moreover, it is also necessary to provide adequate protection against accidental activation of the mushroom button or negligent use of the push-button panel, due, for example, to operators using the box as a support during the descent or ascent into the pit.

EP2336071, always in the name of the Applicant, and EP1641006 disclose control stations which solve this last problem by providing a protective cover which, in closed condition, as well as protecting the various controls, always leaves the mushroom button accessible but at the same time guarantees adequate protection.

However, also in this case the mushroom push-button is arranged on the front face, that is on the same face on which the other push-buttons are also located, with consequent increase of the overall transverse dimensions.

A further limitation of most of the control stations on the market is represented by the fact that the various commands are connected to the respective electrical contacts in a fixed and non-configurable manner, further limiting the flexibility of use of the control station.

SCOPE OF THE INVENTION

It is an object of the present invention to overcome the above drawbacks by providing a control station for electrical installations that is high efficient and relatively cost-effective.

A particular object is to provide a control station for electrical installations which has transverse dimensions, or height, which are relatively small to be installed also in pits of lifts, hoists or the like with reduced maneuvering spaces.

Another object is to provide a control station for electrical installations which is highly configurable to fit to the specific requirements of the system for which it is designed.

Another object is to provide a control station for electrical installations wherein the mushroom emergency button does not contribute to increase the transverse dimensions.

A further object is to provide a control station for electrical installation wherein high protection against accidental operations is provided for all the controls provided.

These objects, as well as others that will appear clearer hereinafter, are reached by a control station for electrical installations which, according to claim 1, comprises a protection box having a side wall with a front face defining a longitudinal axis parallel to its development plane, a plurality of controls anchored to said protection box, at least one of said controls being a mushroom emergency button, a plurality of mutually movable pairs of electrical contacts associated to respective controls and adapted to be connected to one or more power and/or service circuits of the electrical installation for the opening/closing thereof.

Each of said buttons is associated with one or more contact units having respective pairs of mutually movable electrical contacts and arranged in said protection box in a removable manner, to remove or insert one or more contact units according to requirements, ensuring high configurability of the control station as well as a more comfortable maintenance.

By way of example, the same emergency button may be connected to several contact units associated with different circuits of the installation so as to have, simultaneously with the interruption of the main circuit, the activation and/or deactivation of further circuits.

Moreover, the mushroom emergency button is housed in a corresponding seat made on a side face of said side wall orthogonal to said development plane and is anchored to one or more contact units removably housed in said protection box with the respective contacts movable along a direction of movement parallel to said development plane.

The peculiar arrangement of the mushroom emergency button will considerably reduce the maximum transverse dimensions of the box that can be installed even in limited space conditions.

In particular, the mushroom emergency button may be arranged in said housing seat of said side face to be operated along a longitudinal direction.

Moreover, the mushroom emergency button will have a traverse dimension that is completely contained in the maximum height of said box.

In this way, the mushroom button will not radially project from the front face of the box, whose maximum height will define the maximum transverse bulk for the control station, which in this way will have reduced thickness compared to the common boxes for control stations.

Advantageous embodiments of the invention are obtained according to the dependent claims.

BRIEF DISCLOSURE OF THE DRAWINGS EVE

Further features and advantages of the invention will become more apparent in the light of the detailed description of a preferred but not exclusive embodiment of a control station for electrical installations according to the invention, illustrated as a non-limiting example with the aid of the attached drawing tables wherein.

BEST MODE OF CARRYING OUT THE INVENTION

With reference to the attached figures, a preferred but not exclusive configuration of a control station for electrical systems is shown, particularly designed to be connected to a movement or transportation system for people and/or things.

According to a preferred but not exclusive application, the control station will be designed to be installed in the pit of an elevator or hoist.

Figure 1:
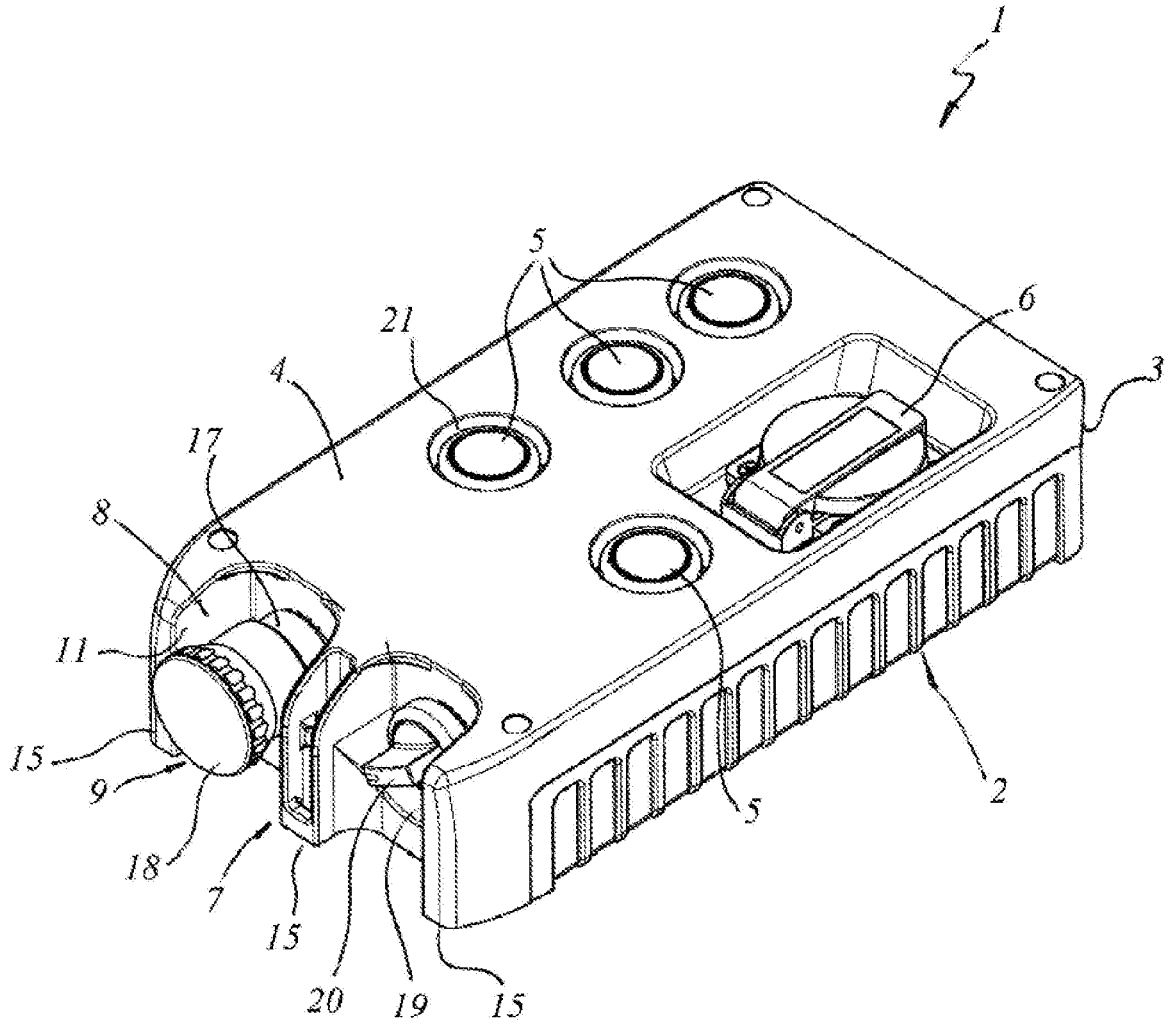
FIG. 1 is a perspective view of a control station of the invention.
Figure 2:
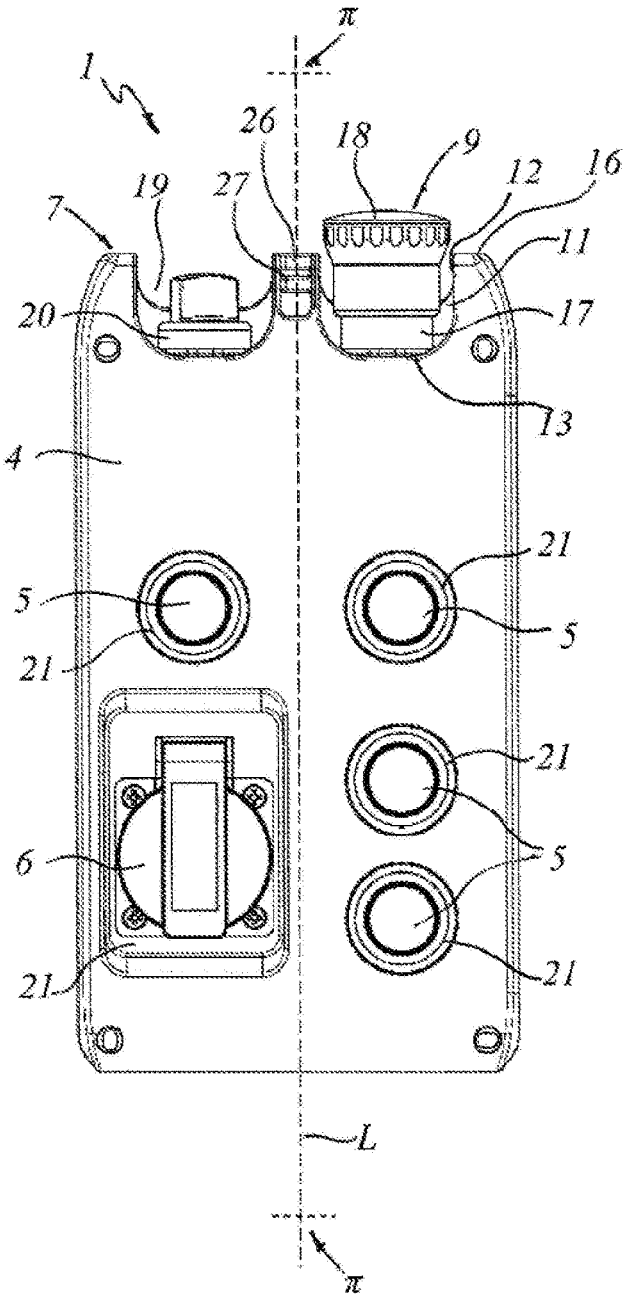
FIG. 2 is a front view of the control station of FIG. 1.

As visible from FIG. 1, the control station, indicated globally by 1, will comprise a protection box 2 having a side wall 3 with a front face 4 having a development plane $\pi$ and defining a longitudinal development axis L parallel to the same development plan $\pi$.

Inside the box 2 there is a plurality of fixed and/or movable electrical contacts, not visible from the figures but which may be of a known type, connectable to one or more power and/or service circuits of the electrical system, not shown, for opening and/or closing thereof.

On the front face 4 of the box 2 a plurality of controls 5 is positioned which can be selected from those commonly present on the market and which are operatively associated with corresponding electrical contacts.

By way of example, in the case where the control station 1 is designed to be installed in the pit of an elevator or the like, the controls 5 may be used to switch on the lighting system or other control lights, to moving up or down the car, to send alarm signals.

The box 2 may also comprise an electrical power socket 6 for connecting electrical devices such as lamps or work tools.

The side wall 3 will be substantially quadrangular, for example with rectangular plan with rounded edges, and on a lateral face 7, transversal to the longitudinal axis of development L and orthogonal to the development plane $\pi$ of the front face 4, will have at least one seat 8 for housing a mushroom emergency button 9, having a typical function for this kind of application.

Preferably, the side face 7 will be the one designed to face upward when the box 2 is mounted on the wall.

In the illustrated configuration, the mushroom emergency button 9 is positioned in the housing seat 8 to be actuated along a substantially longitudinal moving direction X.

Figure 3:
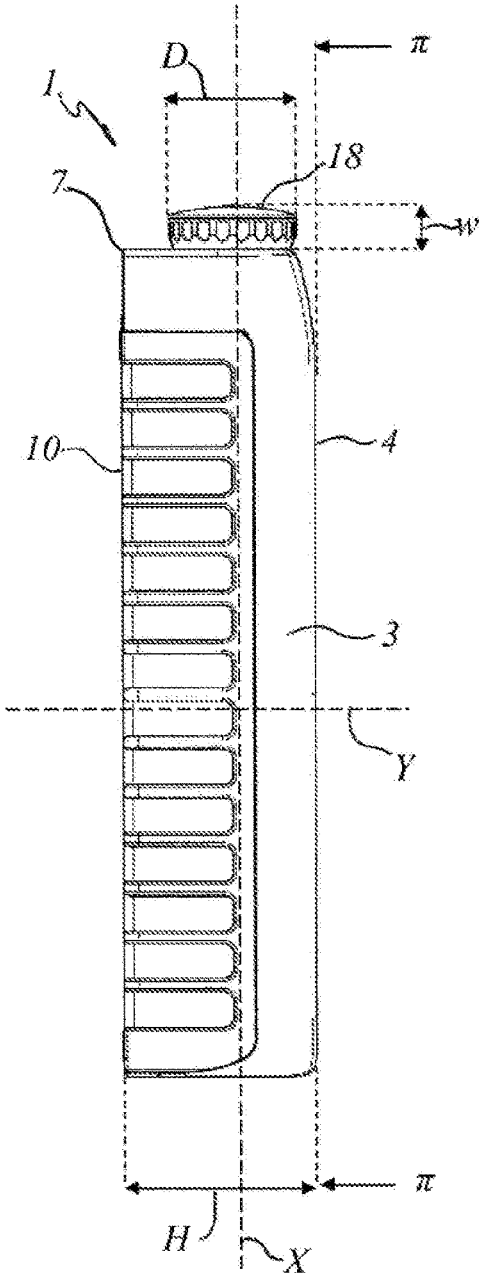
FIG. 3 is a side view of the control station of FIG. 1.
Figure 4:
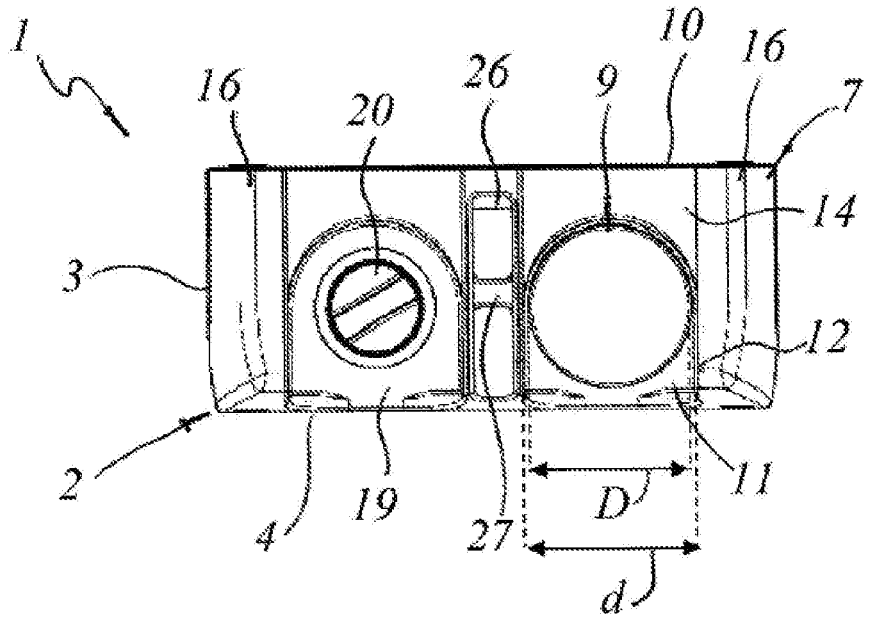
FIG. 4 is a top view of the control station of FIG. 1.

Moreover, the button 9 has a maximum crosswise dimension D completely contained in the maximum height H of the box 2 so as not to protrude with respect to the plane $\pi$ of the front face 4 nor from the parallel plane defined by the rear face 10 designed to be placed on the wall, as can be seen more clearly also from FIGS. 3 and 4.

The housing seat 8 comprises a first recess 11 made in the lateral transverse face 7 and having an upper opening 12 of diameter d close to the maximum transverse dimension D of the emergency button 9, so as to wrap it and guarantee high protection thereof.

In particular, the first recess 11 will have the front side 13 open to allow access to the emergency button 9 and its activation.

Figure 5:
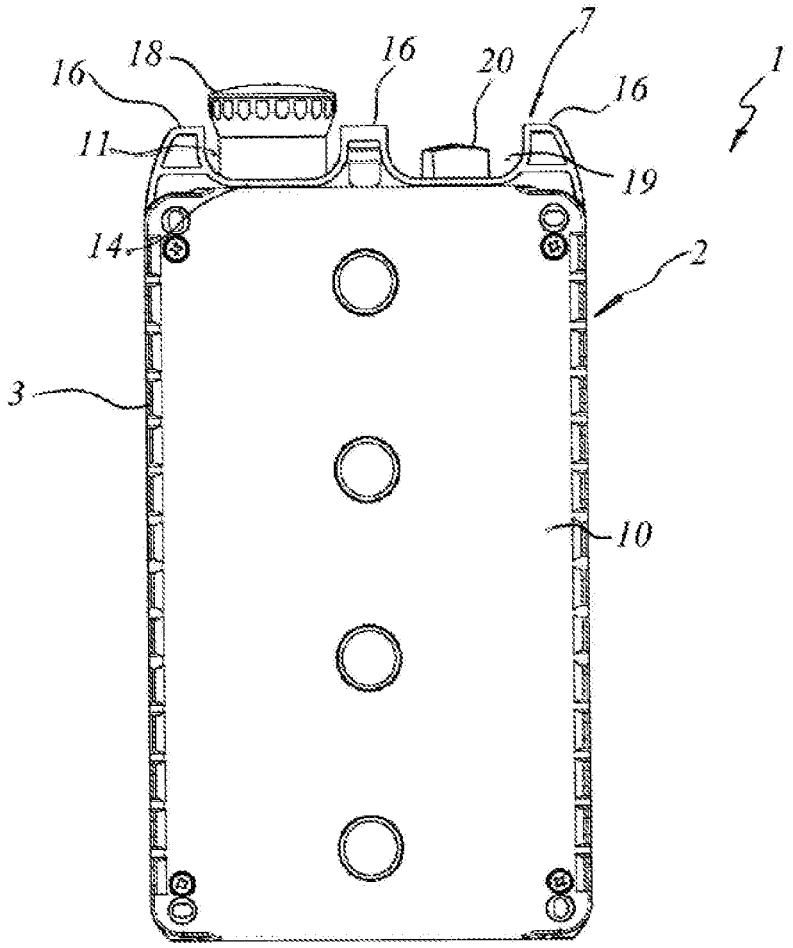
FIG. 5 is a rear view of the control station of FIG. 1.

As can be seen from FIG. 5, the rear side 14 has a lowering placed at a height higher than the base of the first recess 11 and which will join two lateral shoulders 15 having flat upper surfaces 16.

However, in a not shown variant, the rear side 14 may be specular to the front side 13, or alternatively it may be completely closed.

Figure 6:
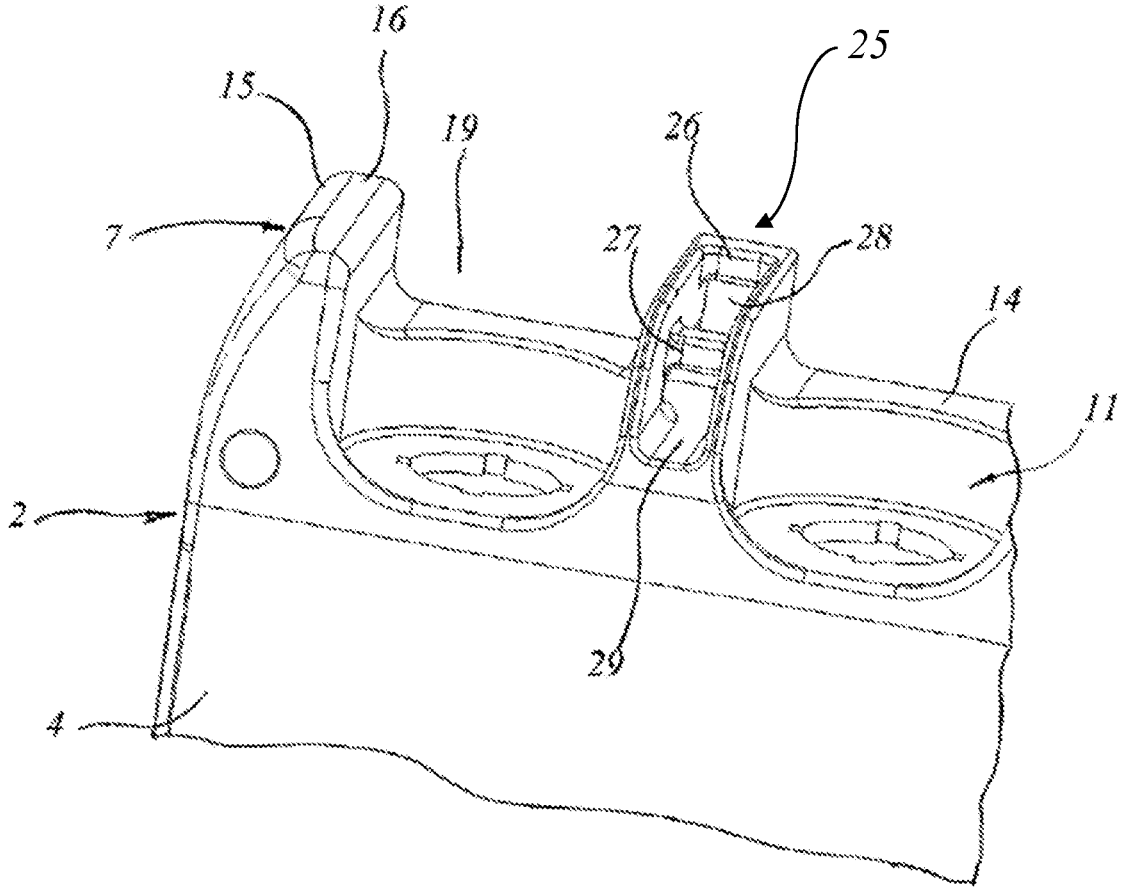
FIG. 6 is a perspective view of a detail of the box of the control station of FIG. 1.

The central shoulder 15 may be full or, as in the version illustrated in the figures and more clearly visible in the detail of FIG. 6, at its correspondence the lateral face 7 provided with the emergency button 9 may comprise a substantially central longitudinal slot 25 provided with a pair of transverse ribs 26, 27 adapted to divide the slot 25 into two channels 28, 29 adapted to receive respective members for fixing the box 2 to a wall or support, such as nails, hooks and the like.

In particular, the two ribs 26, 27 are misaligned to create two channels 28, 29 of different length in order to accommodate fixing members of different sizes.

It is also understood that the number of ribs and therefore of channels may also be different from what is described and illustrated.

The mushroom emergency button 9 has a typical structure for this kind of controls, with a fixed stem 17 completely contained in the first recess 11, and which will partially protrude inside the protection box 2, and a movable head 18 adapted to slide with predetermined maximum stroke on the fixed shaft 17 for the actuation of the respective electrical contact. Conveniently, the movable head 18 will project longitudinally with respect to the two shoulders 15 of the first recess 11 with a predetermined maximum extension w to make the button 9 easier to be operated in any condition.

In the shown configuration, the upper side face 7 also has a second recess 19, flanked to the first recess 11 and substantially identical to it, housing a further control 20, which in this case is a selector.

Regardless of the type of control chosen for the second recess 19, said control 20 will be suitably configured to be completely contained in the maximum height H of the box 2 and more particularly completely contained in the second recess 19.

The controls 5 arranged on the front face 4 will be positioned inside respective housings 21 deigned to also maintain such controls 5 completely contained in the maximum height H of the box 2, so that they cannot protrude with respect to the plane of the front face 4, avoiding additional transverse dimensions with respect to the box 2.

The arrangement and the type of the controls 5 shown in the figure is just one of the many possible combinations.

In particular, the box 2 may be made by means of a tool and a method of the type described in the previously mentioned EP2447972, so as to vary the arrangement of the controls 5 and/or their type according to the requirements.

Figure 7:
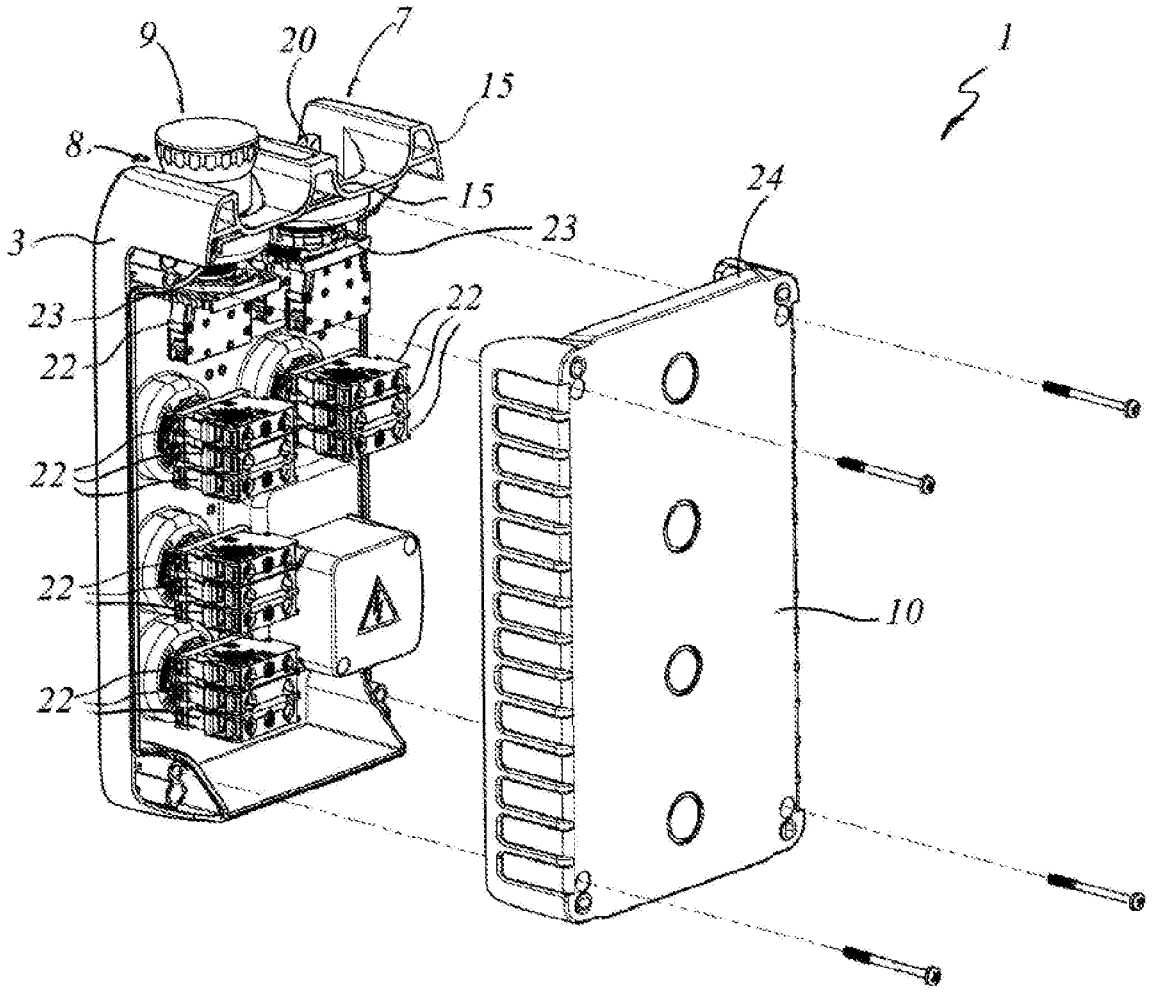
FIG. 7 is an exploded perspective view of the control station of FIG. 1.

FIG. 7 shows the inside of the box 2, with the controls 5 connected to one or more respective contact units 22 housing corresponding pairs of mutually movable contacts to which the terminals of the different circuits to be controlled through the control station 1 will be connected.

From this figure it is also visible that both the mushroom emergency button 9 and the selector 20 located in the second recess 19 are associated with one or more respective contact units 22 arranged in the box 2 in a longitudinal position, i.e. in a position such that the direction of movement X of the respective electrical contacts is substantially longitudinal.

The contact units 22 have respective anchoring means 23 to the corresponding controls 5, 9, 20 of the so-called "panel" type, i.e. connected directly to a stem of the respective control 5, 9, 20 projecting inside the box 2.

In particular, each control 5, 9, 20 comprises respective anchoring means 23 defined by an anchoring plate adapted to be removably fixed to the respective stems to support one or more contact units 22 in a position substantially parallel to each other.

In the case of the emergency button 9 and of the selector 20 the contact units may be parallel to the development plane n of the front face 4, as in FIG. 6, or in a position rotated 90° about the longitudinal axis L with respect to this configuration.

The controls 5 associated with the front face 4 comprise respective anchoring plates 23 suitable for anchoring the respective contact units 22 in a position orthogonal to the same front face 4 with the electrical contacts movable along a transverse direction Y orthogonal to the development plane π.

However, according to a variant not shown, the anchoring of one or more of the contact units 22 associated with the controls 5 may be made directly on the upper wall 24 of the protection box 2.

From above it is clear that the control station according to the invention achieves the intended objects and in particular that of having a highly reconfigurable protective box having a particularly reduced height to be installed even in places with little available space.

The control station according to the invention is susceptible of numerous modifications and variations, all of which are within the inventive concept expressed in the appended claims. All the details may be replaced by other technically equivalent elements, and the materials may be different according to requirements, without departing from the scope of protection of the present invention.

Although the control station has been described with particular reference to the attached figures, the reference numbers used in the description and claims are used to improve the intelligence of the invention and do not constitute any limitation to the claimed scope of protection.

The invention claimed is:

1. A control station for electrical installation, comprising:

a protection box (2) with a maximum height (H) and having a side wall (3), a front face (4) having a development plane (π) and defining a longitudinal axis of development (L) parallel to the development plane (π), a rear face (10) defining a plane parallel to said development plane (π), an upper wall (24), an upper transverse face (7) transverse and perpendicular to said development plane (π) of said front face (4);

a plurality of controls (5, 20) placed on said front face (4);

a mushroom emergency push button (9) having a maximum crosswise dimension (D);

a plurality of pairs of mutually movable electrical contacts associated with respective controls (5, 20) and with said mushroom emergency push button (9) and adapted to be connected to one or more power supply and/or service circuits of the electrical installation;

wherein each of said controls (5, 20) and said mushroom emergency push button (9) are associated with one or more contact units (22) having respective pairs of mutually movable electrical contacts and arranged in said protection box (2) in a removable manner;

wherein said emergency push button (9) is housed in a respective seat (8) formed on the upper transverse face (7) and is anchored to one or more contact units (22) removably housed in said protection box (2) with the respective contacts movable along a movement direction (X) parallel to said development plane (π) and to said longitudinal axis of development (L);

wherein said upper transverse face (7) is transverse and perpendicular to said longitudinal axis of development (L) and is designed to face upward;

wherein said seat (8) comprises a first recess (11) formed in said upper transverse face (7) and having an open front side (13) which allows the access to and the activation of said mushroom emergency button (9) and an upper opening (12) with diameter (d) next to the maximum crosswise dimension (D) of said mushroom emergency push button (9);

wherein said mushroom emergency push button (9) is arranged in said seat (8) to be operated along the movement direction (X) and has the maximum crosswise dimension (D) completely contained in the maximum height (H) of said protection box (2);

wherein said mushroom emergency push button (9) does not protrude with respect to said development plane (π) of said front face (4) nor from the plane defined by said rear face (10).

2. The control station as claimed in claim 1, wherein said controls (5, 9, 20) comprise respective anchoring means for one or more contact units (22), the anchoring means of said emergency push button (9) comprising an anchoring plate (23) adapted to be removably fixed to a stem (17) of said mushroom emergency push button (9) to support one or more contact units (22) in a position substantially parallel to said development plane (π).

3. The control station as claimed in claim 1, wherein the controls (5) associated with said front face (4) comprise respective anchoring means (23) adapted to allow anchoring of a contact unit (22) directly to a stem of one of the controls (5) projecting inside said protection box (2) said contact unit (22) being arranged in said protection box (2) with the electrical contacts movable along a transverse direction (Y) orthogonal to said development plane (π).

4. The control station as claimed in claim 1, wherein said upper lateral face (7) has one or more further recesses (19) which house the respective controls (20) completely contained in the maximum height (H) of said protection box (2).

5. The control station as claimed in claim 4, wherein the controls (20) housed in said one or more additional recesses (19) are associated with respective one or more contact units (22) arranged in said protection box (2) with the electrical contacts movable parallel to said movement direction (X).

6. The control station as claimed in claim 1, wherein said front face (4) comprises one or more housings (21) for corresponding controls (5) of said plurality of controls designed to keep said controls (5) completely contained in the maximum height (H) of said protection box (2).

7. The control station as claimed in claim 1, wherein said lateral face (7) provided with said emergency push button (9) comprises a substantially central longitudinal slot (25) provided with one or more transverse ribs (26, 27) adapted to divide said slot (25) in two or more channels (28, 29) adapted to receive respective members for fixing said box (2) to a wall or support.

* * * * *